United States Patent [19]

Turini

[11] Patent Number: 5,052,196

[45] Date of Patent: Oct. 1, 1991

[54] PNEUMATICALLY SOCK TENSIONING AND REVERSING DEVICE FOR KNITTING MACHINE

[76] Inventor: Francesco Turini, Via I° Maggio No. 2, Stabbia Fraz. Com. Cerreto Guidi (FI), Italy

[21] Appl. No.: 309,772

[22] Filed: Feb. 10, 1989

[30] Foreign Application Priority Data

| | | | |
|---|---|---|---|
| Feb. 17, 1988 | [IT] | Italy | 9332 A/88 |
| Mar. 30, 1988 | [IT] | Italy | 9371 A/88 |
| Jun. 29, 1988 | [IT] | Italy | 9436 A/88 |

[51] Int. Cl.[5] ..... D04B 15/92

[52] U.S. Cl. ..... 66/149 S; 66/95

[58] Field of Search ..... 66/149 S, 149 R

[56] References Cited

U.S. PATENT DOCUMENTS

| | | | |
|---|---|---|---|
| 3,267,698 | 8/1966 | Poteat | 66/149 S |
| 4,339,932 | 7/1982 | Lonati | 66/149 S X |

FOREIGN PATENT DOCUMENTS

| | | | |
|---|---|---|---|
| 1040384 | 8/1966 | United Kingdom | 66/149 S |
| 1055701 | 1/1967 | United Kingdom | 66/149 S |
| 1314977 | 4/1973 | United Kingdom | 66/149 S |
| 2133049 | 7/1984 | United Kingdom | 66/149 S |

*Primary Examiner*—Reynolds, Wm. Carter
*Attorney, Agent, or Firm*—McGlew & Tuttle,

[57] ABSTRACT

A device for pneumatically tensioning and reversing tubular manufactured articles such as socks, upon completion, by a circular knitting machine. The device includes a small diameter rotating needle cylinder. The device has an external tubular casing and an internal element for forming an interspace with an annular cross section for pneumatic tensioning. The internal element forms an axial passage inside which the manufactured article is turned inward and reversed during a pneumatic operation where the article is reversed and conveyed away. Both the tubular casing and the internal element consist of two sections with different diameters. Upper sections with a smaller diameter are accommodated within the needle cylinder and the lower sections with a larger diameter are located outside and adjacent to the needle cylinder. Structure is provided for forming an annual discontinuity between the two sections of the internal element such that after a phase involving formation with pneumatic tensioning, a second phase involving inward turning and reversal can be performed along the end edge of the tubular section of the internal element with a larger diameter and within the section.

11 Claims, 7 Drawing Sheets

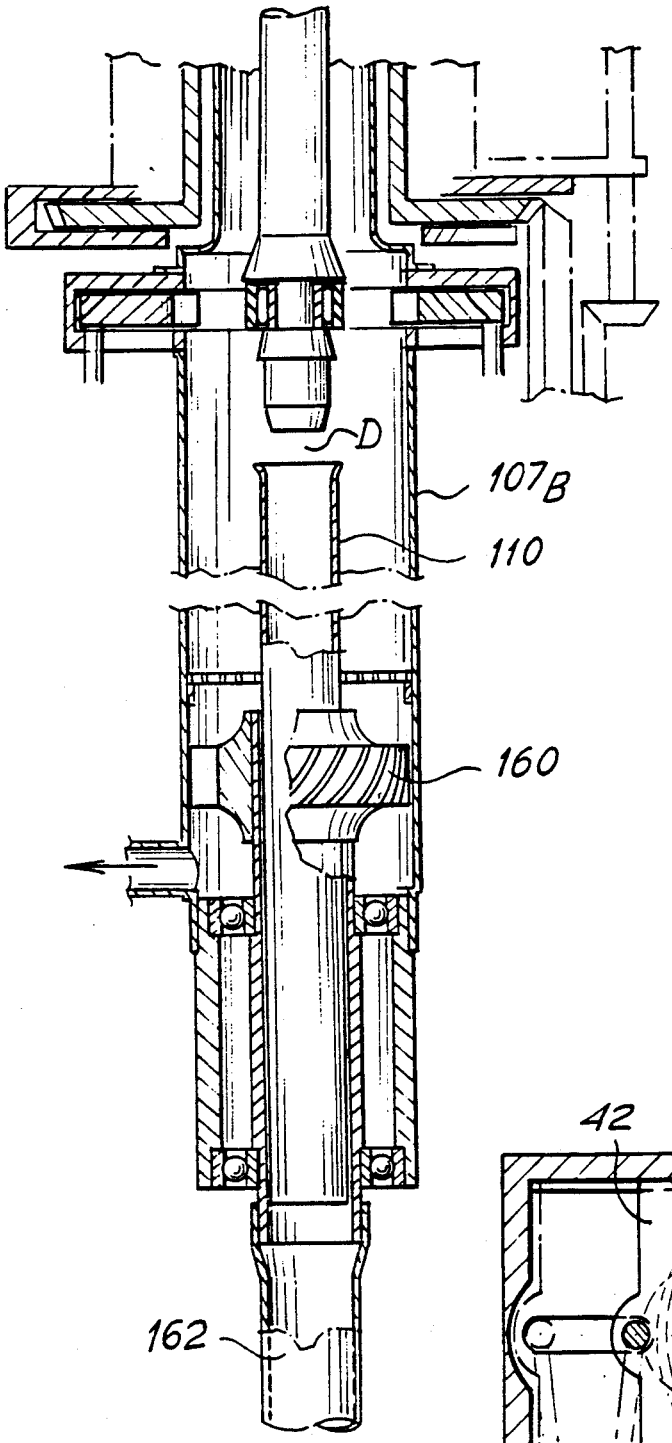
Fig. 3
Fig. 2
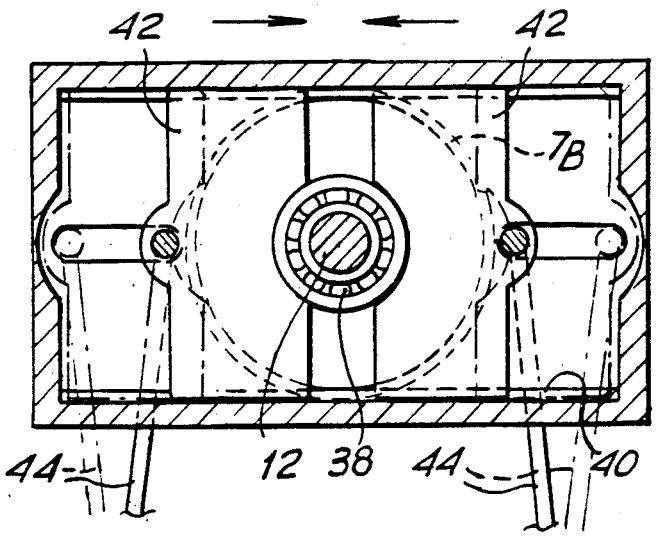

PNEUMATICALLY SOCK TENSIONING AND REVERSING DEVICE FOR KNITTING MACHINE

FIELD AND BACKGROUND OF THE INVENTION

The invention relates to the production of socks with a thread mesh relatively larger than that of women's stockings and to the problem of tensioning the manufactured articles and reversing them after each manufactured article has been formed. There are in existence pneumatic tensioning and reversing devices for tubular manufactured articles such as stockings and the like, reversing being performed upon completion by the circular knitting machine with a rotating-needle cylinder. Devices of this type have an external tubular casing and a rotating internal tube; an interspace with an annular cross section is thus defined, this interspace being used for pneumatic tensioning—by means of suction—of the manufactured article which during formation surrounds the internal tube (which therefore must rotate); after the manufactured article has been separated from the needle cylinder used for its production, the airflow is reversed so as to cause a sucking action inside the rotating tubular duct and advantageously also a pneumatic thrusting action on the manufactured article which surrounds the said rotating tube and which is located in the interspace; this arrangement results in inward turning and hence reversal of the manufactured article, from the external interspace with an annular cross section into the internal tube, the reversed manufactured article being pneumatically conveyed away through a pneumatic duct of which the said rotating internal tube forms part.

Devices of this kind are difficult to apply in circular knitting machines and the like, of the type for forming socks, where the manufactured article is relatively large and the needle cylinder has a relatively small diameter, it being extremely difficult to arrange inside the needle cylinder both the external tubular casing and the rotating internal tube so as to be able to perform the operations of tensioning and in particular reversing the manufactured article within the internal tube, the latter having too small a diameter for the inward turning operation and hence reversal to be performed properly.

The device in question has been designed in order to solve this problem in machines which have a cylinder with a relatively small diameter.

The device in question is an improvement to that indicated above, with an annular interspace from which the manufactured article is turned inward and reversed during an operation where the said article is reversed and pneumatically conveyed away. According to the invention, both the said tubular casing and an internal element—which is at least partly tubular—consist of two sections with different diameters, the upper sections with a smaller diameter being accommodated within the needle cylinder, while the lower sections with a larger diameter are located outside and adjacent to the needle cylinder; means are provided for forming an annular discontinuity between the two sections of the said internal element so that, after a first phase involving formation with pneumatic tensioning, a second phase involving inward turning and reversal can be performed along the end edge of the tubular section of the internal element with a larger diameter, and within the said section.

In practice, the section of said internal element with a smaller diameter is joined to an enlargement so as to have a diameter at least equal to that of the tubular section of said internal element with a larger diameter.

The sections of the internal element are movable axially relative to each other so as to create the said annular discontinuity during the reversal phase. In a possible embodiment, the tubular section of the internal element with a larger diameter can be displaced axially so as to move towards and away from the said enlargement, in order to form the said annular discontinuity during the reversal phase.

Advantageously, the enlargement of the section of the internal element with a smaller diameter can be engaged into (and disengaged from) the end of the tubular section of the internal element with a larger diameter, which thus supports—during the tensioning phase—the said section with a smaller diameter; in addition, provision is made for slide means with jaws or the like, which from the outside are moved across the interspace with an annular cross section so as to engage temporarily the said section of the internal element with a smaller diameter at the end of the tensioning phase—after the manufactured article has been separated from the needles—and during the reversal phase. Said means with jaws or the like may engage said section of the internal element with a smaller diameter via ball bearing means so as to allow rotation.

The tubular section of the internal element with a larger diameter may be rotational and capable of rotating with the said upper section of said internal element with a smaller diameter; said tubular section with a larger diameter may be driven, i.e. operated in rotation, or may be free to rotate, and in this latter case may be combined with an air-type propulsion system which uses the suction airflow prevailing inside the annular interspace for tensioning.

In a different embodiment, the section of said internal element with a smaller diameter may be driven in rotation by the plate; it may be capable of being coupled with the plate via a friction joint with axial pressure or the like.

Also, in another embodiment, the enlargement of the section of the internal element with a smaller diameter has rolling bearing means or the like for engagement with the tubular section.

Moreover, the section of the internal element with a smaller diameter may be tubular and, via said section and the section of said internal element with a larger diameter, there may be created a pneumatic thrusting force, from the end in the interspace, in the same direction as the tensioning airflow for suction, said thrusting force tending also to widen the manufactured article.

According to yet another solution, said section with a smaller diameter, together with the corresponding enlargement of the internal element, is mounted on a rod passing axially through the rotating structure of the plate and driven rotatably by it, and, via said rod, the said section of the internal element with a smaller diameter is operated axially so as to move towards and away from the tubular section with a larger diameter, which may be fixed.

According to another embodiment, the upper section of the internal element is formed as a rod which is suspended from the hook plate and is able to lift therewith; means are advantageously provided to ensure the centering of the lower enlargement of the rod over the lower tubular section of the internal element with a larger diameter, even upon the mutual moving away.

The lower enlargement of the rod—mostly having a dual truncated cone shape—may have a thin appendix which remains centered within the upper opening of the lower section of the internal element with a larger diameter, even after the enlargement and the lower section have been mutually moved apart in order to form the annular discontinuity for the reversing operation.

The rod may be hinged to the plate, or may be at least partially flexible, to allow the lifting of the plate about a hinge having horizontal axis, i.e. with an angular movement.

According to a further improvement, air inlet holes are also provided as well as means for controlling the opening and closing thereof, in order to reduce the speed of the air which flows through the section of the casing which is inside the needle cylinder and closer to the working zone of the needles.

Said holes may be formed around the upper portion of the external section with a larger diameter of the casing, and around the latter there may be provided a sliding sleeve shutter operable by the program which controls the machine.

Advantageously, below the set of holes, a slotting may be provided for access to the inside of the tubular casing; said slotting may be closed by the sleeve shutter and opened by an extra-run of the latter to gain access inside the device.

An annular shaped structure which is adjustable in position to regulate the air flow may be provided inside the section with a larger diameter of the casing. A grid which is adjustable in position in order to intercept the article and position it as suitably as possible for its reversing may be provided within the interspace between the two sections with a larger diameter.

The upper section of the internal element with a smaller diameter may be designed in the form of a rod having an enlargement at its lower end, which is idly supported on said rod.

The present invention will be better understood with reference to the description and accompanying drawing, which shows a practical non-limiting example of the invention itself. In the drawing:

FIGS. 1 and 2 show an embodiment in schematic vertical section and horizontal section;

FIG. 3 shows a second embodiment of the invention in schematic vertical section;

DETAILED DESCRIPTION OF THE PREFERRED EMBODIMENT

Figure 1:
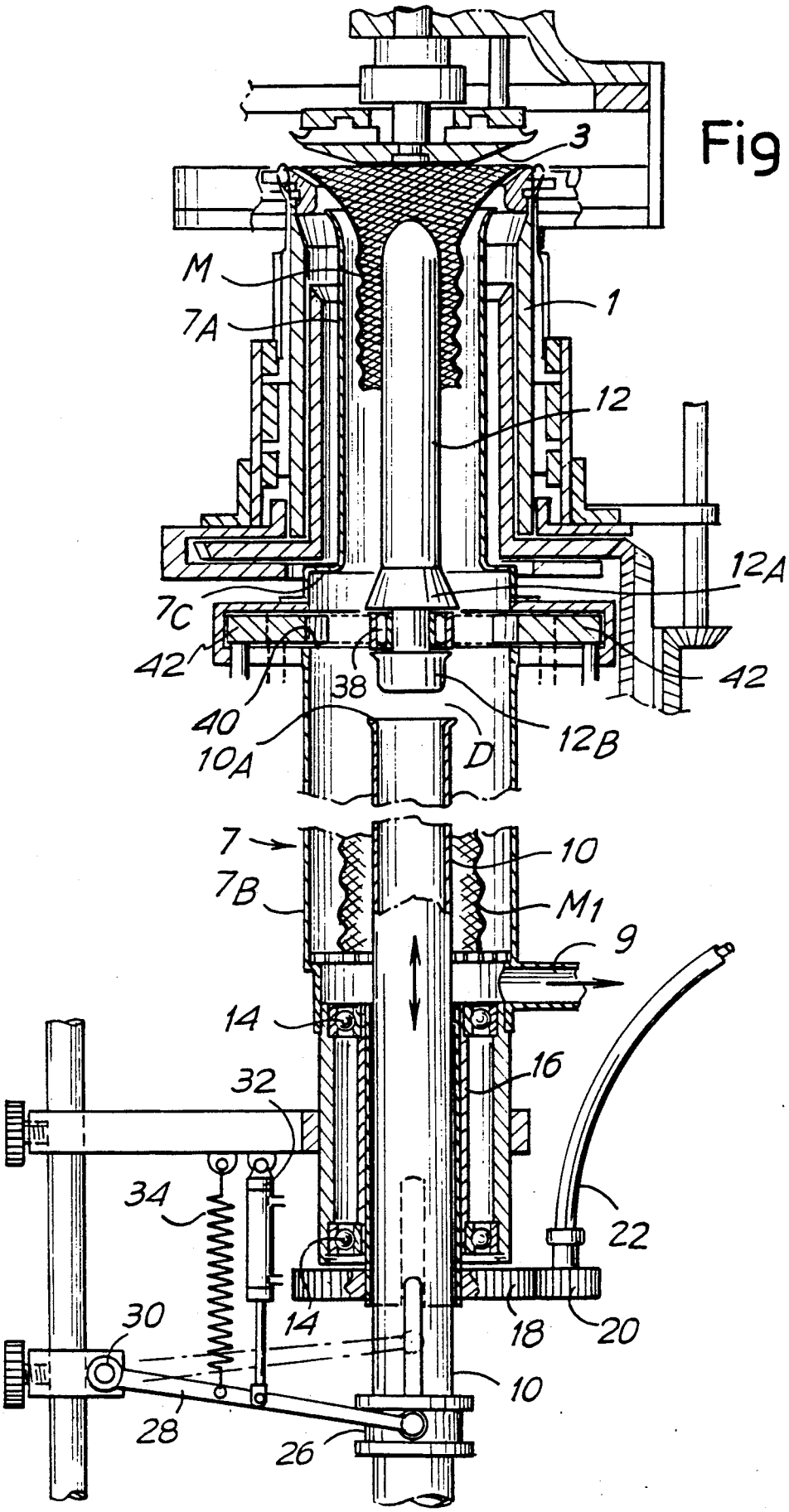

According to that illustrated in FIG. 1 of the accompanying drawing, 1 denotes in an entirely schematic manner the needle cylinder which rotates and which cooperates with a so-called plate 3 located above and coaxial with the cylinder itself and rotating in synchronism with the latter. The manufactured article M which is formed is tubular and gradually advances during formation inside the needle cylinder 1. In order for the manufactured article to be correctly formed, it must be tensioned; this can be performed pneumatically using the device according to the invention, which subsequently enables the manufactured article to be reversed.

The device comprises an external tubular casing 7 consisting of two sections, an upper section with a smaller diameter 7A and a lower section with a larger diameter 7B, joined together at 7C. The tubular casing 7 is coaxial with the needle cylinder and fixed to the frame of the machine. At the bottom of the lower section 7B with a larger diameter there is provided a lateral opening 9 connected to a pneumatic installation which, during formation of the manufactured article, performs a pneumatic sucking action in order to tension the manufactured article M and, during the subsequent reversal and removal operation, is able to perform a pneumatic thrusting action for the purposes indicated below. The upper section 7A of the tubular casing with the smaller diameter has a receiving, funnel-type end for insertion of the manufactured article M being formed within it, and is assisted in this operation by the suction airflow used for tensioning.

Inside the tubular casing 7, a rotating internal element extends so as to define, together with the casing 7, an interspace with an annular cross section. This rotating internal element comprises a lower tubular section with a larger diameter 10 and an upper section with a smaller diameter 12 (which may also be solid male part), with a widening connection piece, i.e. a lower enlargement 12A. The section 12 is located inside the section 7A of the external casing with the smaller diameter, while the section 10 of the internal element with the larger diameter is located inside the section 7B of the tubular casing with the larger diameter. The two sections 7B and 10 are located underneath and outside, although adjacent to the cylinder 1; the said sections 7B and 10 located underneath the cylinder 1 have diameters such that inward turning can be easily performed so as to reverse the manufactured article, but have diametral dimensions such as to prevent them being inserted inside the needle cylinder 1, the diameter of which is relatively small. The upper sections 7A and 12 of the tubular casing and of the internal element respectively, however, have diametral dimensions such that they can be accommodated inside the interspace of the needle cylinder and such that an interspace can be formed between the section 7A and the male part 12, which is adequate to allow pneumatic tensioning of the manufactured article M being formed.

The section 10 of the internal element with a larger diameter is capable of rotating and capable of performing axial movements in the direction of the double arrow shown in the drawing. For this purpose, provision is made, inside the tubular structure of the section 7B of the external tubular casing, for a support system consisting of two bearings 14 which rotatably support a sleeve 16 capable of rotating by means of a crown gear 18 and a pinion 20 operated for example by a flexible transmission 22 or in another suitable manner; the tubular section 10 of the internal element is slidable axially inside the sleeve 16 and is driven in rotation by the sleeve itself via a splined drive system. For the axial movements, the section 10 has below the crown gear 18 an annular groove 26 inside which there is able to engage a fork 28 hinged with the frame at 30 and operated so as to perform angular movements by a cylinder/piston system 32 with the intervention, if required, of a counter spring 34, and in a manner in any case such that it is possible to obtain, via the fork 28 and the annular groove 26, the axial movements of the section 10 of the internal element, rotation of the said section 10, however, being permitted.

The section 10 of the internal element with the larger diameter has an upper edge 10A shaped so as to facilitate reversal in the manner described below and also so as to be fitted over the enlargement 12A of the upper section 12 of the internal (or male) element with a smaller diameter, and in particular over a portion 12B of the said enlargement 12A. A rolling bearing 38 is arranged between the two parts 12A and 12B of the section 12 for the purposes indicated below. On the fixed structure of the machine there are provided sliding guides 40 for two slides 42, which are capable of sliding in a diametral direction with respect to the bearing 38, being arranged at the same level as the said bearing. The two slides 42 form two jaws designed to engage and support the bearing 38, keeping it centered coaxially with respect to the needle cylinder 1, the slides 42 performing a centripetal radial movement so as to move together. In order make the slides 42 perform these movements, cylinder/piston systems or arms, such as 44 in FIG. 2, are provided, so as to obtain simultaneous centripetal and centrifugal displacement, respectively, of the two slides 42. In the position reached after centrifugal displacement, the slides 42 leave an interspace completely free between the bearing 38 and the external tubular casing, i.e. between the section 12, 12A, 12B and the external tubular casing 7A, 7C, 7B; the interspace with an annular cross section is further defined by the lower sections 7B and 10 of the tubular casing with a larger diameter and the rotating internal element, respectively.

During the phase when the manufactured article M is formed and hence pneumatically tensioned, the tubular section 10 of the rotating internal element with its own shaped end 10A is engaged onto the enlarged portion 12B of the connection piece 12A, 12B of the upper section 12, with a smaller diameter, of the internal element, such that the same tubular section 10 is able to hold the section 12B, 12A, 12 with a smaller diameter, in a correct position inside the needle cylinder so as to allow pnuematic tensioning in the interspace defined between the sections 7A and 12 inside the needle cylinder; the slides 42 are extracted centrifugally and ensure the continuity of the interspace with a circular cross section both in the internal part of the needle cylinder between the sections 7A and 12 and the lower part between the sections 7B and 10. During the course of formation of the manufactured article, the manufactured article being formed also reaches the connection piece 12A and the interspace between the sections 7B and 10. In any case, at the end of formation of the manufactured article, when the manufactured article itself is separated from the needle cylinder, it is drawn into the lower part of the annular interspace between the sections 7B and 10 owing to the pneumatic drawing action which caused tensioning during formation. The manufactured article therefore arranges itself around the internal rotating tubular section 10 and inside the interspace defined externally by the section 7B. In these conditions, the manufactured article must be reversed. For this purpose, the slides 42 are set for centripetal travel and their internal jaw-shaped profiles engage the ball bearing 38 and, with it, the upper section 12, 12A, 12B with a smaller diameter; the tubular lower section 10 of the internal element with the larger diameter is lowered axially such that an annular discontinuity D occurs between the enlarged portion 12B of the upper section with a smaller diameter 12, 12A, 12B and the upper end edge 10A of the tubular section 10 with a larger diameter, wide enough to allow inward turning and reversal of the manufactured article M. At this point, the sucking action is switched over so that a sucking action is exerted inside the tubular section of the internal element and, if necessary, a pneumatic thrusting force is exerted through the opening 9. The manufactured article, which has gathered inside M1 in the interspace between the section 7B and the section 10, is thus pushed upwards until it reaches the edge 10A and turns in on itself inside the tubular section 10 with a sufficiently large diameter for this inward turning operation; the manufactured article M1 then enters the section 10 and from here passes into a pneumatic conveying duct connected to the said section 10 at the bottom, until it reaches further stations where it is processed or manually removed. In view of the possible dimensions of the sections 7B and 10, this inward turning and reversing operation takes place without any difficulty. Suction within the section 10 of the internal duct occurs mainly through the annular interpace between the sections 7B and 10, since the same slides 42, projecting into the annular interspace so as to engage the bearing 38, prevent the penetration of air through the interspace between the sections 7A and 12. The upper section 12 of the internal element may also be closed, i.e. may be a solid male part, without affecting the operability of the assembly.

After the manufactured article has been reversed and conveyed away, the lower section 10 of the internal element with a larger diameter is raised again by the system 26, 28, 32 and inserted again onto the enlargement 12B so as to engage again the upper section 12, 12A 12B, temporarily supported by the slides 42; therefore, the slides 42 can be moved centrifugally so as to restore the continuity of the annular interspace between the sections 7A and 12 and the sections 7B and 10, so that a new production cycle for the manufactured article can be resumed and the latter can therefore be pneumatically tensioned.

According to that shown in FIG. 3, the arrangement is similar to that of the preceding example, except that the propulsion of the tubular section 110 (similar to 10), instead of being effected positively by a mechanical drive, is obtained by an air-type, i.e. turbine propulsion system denoted by 160 and extending inside the interspace between the section 110 and the section 107B (corresponding to 7B in the preceding example); therefore the turbine or air-type propulsion system 160 uses the suction airflow for tensioning, prevailing inside said interspace during tensioning. The arrangement comprises a system similar to the engaging and disengaging system 12, 12A, 12B and a retaining system with jaws such as 42 which, in fact, are not shown in greater detail in the said FIG. 3. In view of the fact that the section 110 is kinematically independent, the said section 110 can also be entrained by the manufactured article which envelopes it and is able to accelerate or brake it with respect to the movement obtained by the propulsion system 160.

Figure 4:
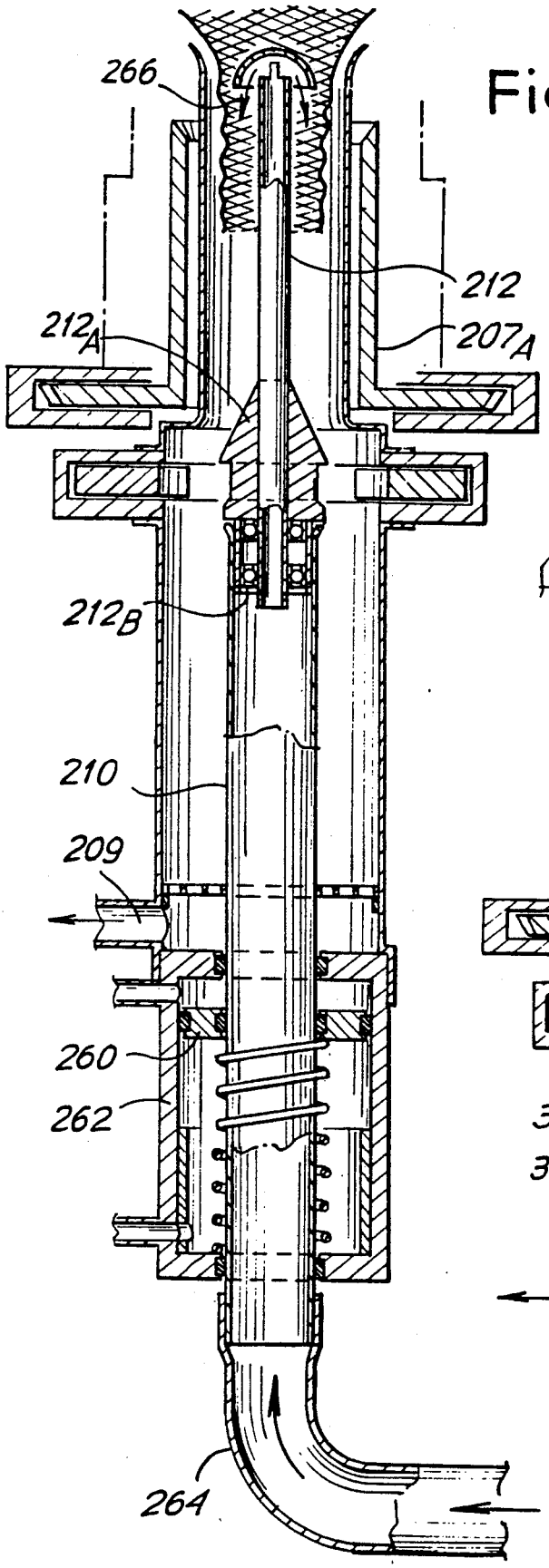
FIG. 4 shows a third embodiment of the invention in schematic vertical sections.

According to the further embodiment illustrated in FIG. 4, the section 210 of the internal element with a larger diameter can be moved axially as in the preceding examples, in order to engage and disengage with respect to the upper section with a smaller diameter, but does not rotate. This section 210 may be operated by the piston 260 of a cylinder/piston system with a cylinder 262 and a double-acting piston 260 or with a counter spring for effecting, for example, raising and engaging operations. The upper section 212 of the internal element with a smaller diameter can be engaged via the assembly 212B, which can be covered by the top end of the section 210 when displaced upwards. The enlargement 212B can be combined with rotating systems, for example with ball bearings, for releasing it relative to the section 212, such that the latter may be capable of rotating independently of the section 210 although supported by the latter via the enlargement 212B, over which the end of the section 210 fits. The enlargement 212A of the said upper section with a smaller diameter 212, which is similar to the enlargement 12A of the first example, is capable of being engaged by the jaws of a system similar to 40, 42, but may be engaged by the jaws themselves independently of the presence of its own rolling system, such as 38 in the first example. The upper section 212 is tubular and communicates with the tubular section 210 with a larger diameter, the latter communicating with a duct 264, in such a way that an airflow blown from the duct 264 through the section 210 reaches and passes through the tubular section 212 so as to escape from the nozzle 266 formed at the end of the section 212 and directed downwards within the interspace defined between the upper section 207A of the external casing (corresponding to 7A) and the said section 212. This blown air causes widening of the manufactured article M which penetrates into the interspace during the formation of the manufactured article itself, in addition to pushing it downwards, i.e. in the same direction in which tensioning occurs as a results of suction via a suction outlet 209, similar to 9 in the first example. The manufactured article therefore does not tend to hug the section 212, but instead may be expanded; however, since this section 212 is able to rotate, this section 212 may be driven without the danger of the manufactured article becoming twisted and trapped on it. The length of the section 212 and of the enlargement 212A may be sufficient for the manufactured article, during formation and tensioning, not to reach the tubular section 210 which has a larger diameter and is of the non-rotary type in this embodiment; therefore, the possibility of the manufactured article getting trapped on this section 210 can be excluded. The section 212, 212A, 212B can be engaged by systems of slides and jaws such as 40, 42.

Figure 5:
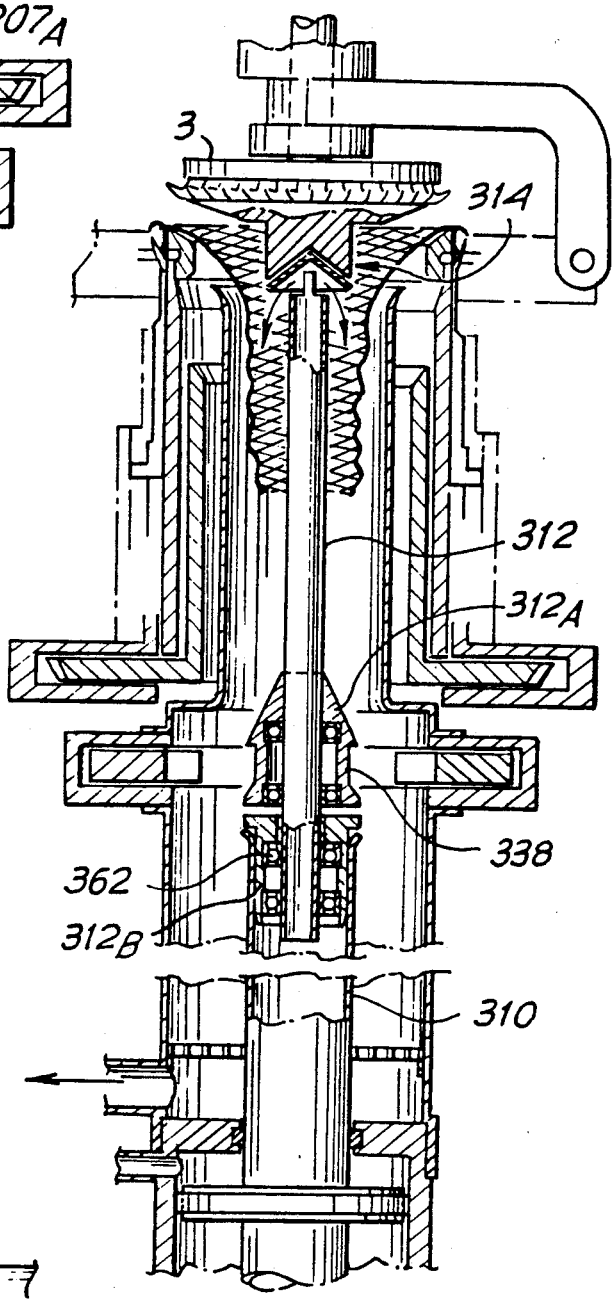
FIG. 5 shows a fourth embodiment of the invention in schematic vertical sections.

A further embodiment in which the tubular section of the internal element with a larger diameter does not rotate is shown in FIG. 5. In this embodiment, the tube 310, which constitutes the section of the internal element with a larger diameter can be moved axially but does not rotate and is able to engage with the upper section 312 of the internal element with a smaller diameter via a rolling system 362 combined with the enlargement 312B which serves precisely to perform a coupling operation with the end of the section 310. Via the rolling system 362, the enlargement 312B supports the section 312, which is able to rotate freely relative to the said enlargement 312B and relative, therefore, to the tubular section 310 with a larger diameter, which can be moved axially but not rotatably. The section 312 can further be engaged and supported by jaw means and by slides such as 40, 42 in the first example, via a rolling system 338 similar to 38, so as to allow rotation of the section 312 even with engagement by the jaws. The section 312 may be driven by the plate 3 via an axial coupling joint 314, of the friction type moreover, for example with a conical or equivalent surface of revolution, in such a way that the said section 312 can be driven by the movement of the plate 3, which is synchronized with that of the needle cylinder in a conventional manner. This axial-friction engaging joint 314 may be coupled by means of an elastic pressure which can be obtained via elastic means acting axially either on the member integral with the hook plate or on the member integral with the section 312. With this arrangement, during operation, i.e. during formation of the manufactured article, the section 312 is made to rotate by the plate 3 and this section 312 may extend axially so as to prevent the manufactured article reaching the non rotating tubular section 310 during formation. The possibility of the manufactured article becoming twisted or getting trapped during formation on the non-rotating section 310 is thus avoided.

In all the solutions of FIG. 3, 4 and 5, reversal is obtained, as in the first example (FIG. 1), via the formation of an annular passage such a annular passage D FIG. 1) between the lower section with larger diameter 110, 210 or 310 and the upper section 112, 212 or 312 through lowering of the lower section with a larger diameter 110, 210 or 310 relative to the engaging assembly of the upper section 112, 212 or 312 after engagement of the said section 312 by the sliding jaws such as 42 or other equivalent means.

Figure 6:
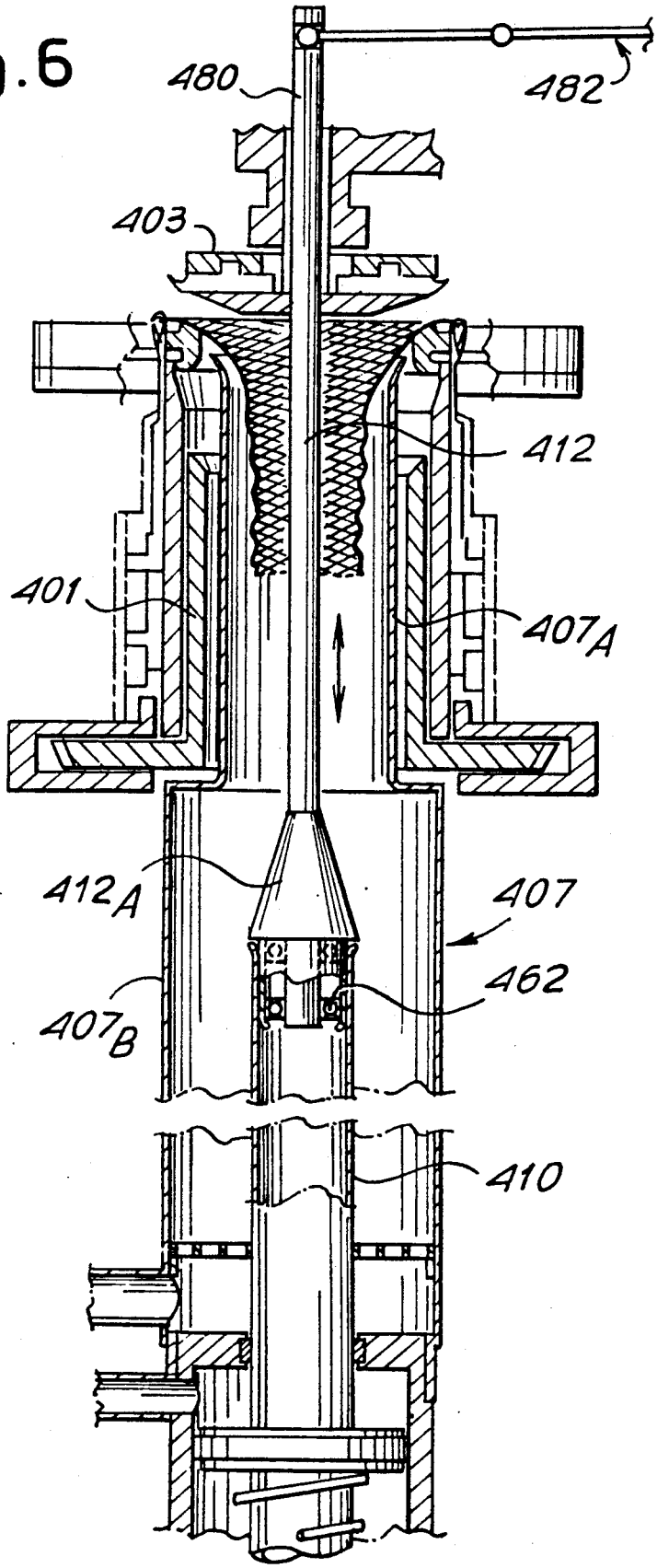
FIG. 6 shows a fifth embodiment of the invention in schematic vertical sections.

In the embodiment in FIG. 6: 401 denotes the cylinder; 403 denotes the plate; 407A, 407B denote the two sections of the tubular casing 407; 410 denotes the lower tubular section of the internal tubular element with a larger diameter, which may not rotate; 412 denotes the upper section of said internal element with a small diameter, which has an enlargement 412A designed to engage in the top end of the section 410 via rolling means 462. The section 412 extends in the form of a rod 480 which passes axially through the structure of the plate 403 and of its shaft, and is able to rotate together with the latter and slide axially relative to it being driven by a kinematic mechanism indicated in brief by 482, so as to be able to move the enlargement 412A away from the section 410 in order to form the annular discontinuity between the sections 410 and 412 for the purpose of performing the inward turning operation. The length of the element 480, 410 is such that the manufactured article is separated from the needles before reaching, during tensioning, the non-rotating section 410.

According to a possible modification of the embodiment of FIG. 1 upper section 12, 12A, 12B of the internal element with a smaller diameter may be constrained and supported with respect to the plate 3 of the circular machine. In this case, by providing the enlarged portion 12B with a suitably larger diametral dimension, relative to the edge 10A of the tubular section 10, it is even possible to eliminate the axial movement of the section 10, since coupling of said section 10 and the enlargement 12B is no longer necessary in order to support the section 12 which, in this case, is suspended from the plate.

In FIG. 7 to 10, 501 denotes the rotating needle cylinder, and 503 very roughly denotes the hook plate overhanging the needle cylinder and which is carried by a structure articulated at 505 according to a horizontal and lateral axis, to allow the lifting of the plate from the upper end of the needle cylinder according to arrow f503 in the drawing, in order to provide access for service and allow working conditions to be resumed.

507 denotes the upper section with a smaller diameter of the tubular casing which defines the passage for the pneumatic tensioning of the manufactured article during its formation; 509 denotes the lower section with a larger diameter of said casing, which extends beneath the needle cylinder. 512 denotes the lower tubular section of the internal element which, together with section 509, defines the interspace of annular cross-section where the manufactured article being formed is collected prior to being reversed.

Inside the casing 507, 509 there is provided a rod 514 cooperating with the lower tubular section 512, which rod has in its lower part an enlargement 516 substantially conical and combined with a further conical portion 518 which is opposed to the previous one and which is supported by ball bearings or other means in order to idly rotate with respect to the enlargement 516. The portion 518 of the enlargement 516 is provided with a very thin and relatively long appendix 520 which extends downwardly for the purposes indicated below. The assembly 516, 518, 520, via the rod 514, is articulated at 522 below the plate 503 and can rotate with the latter.

Figure 7:
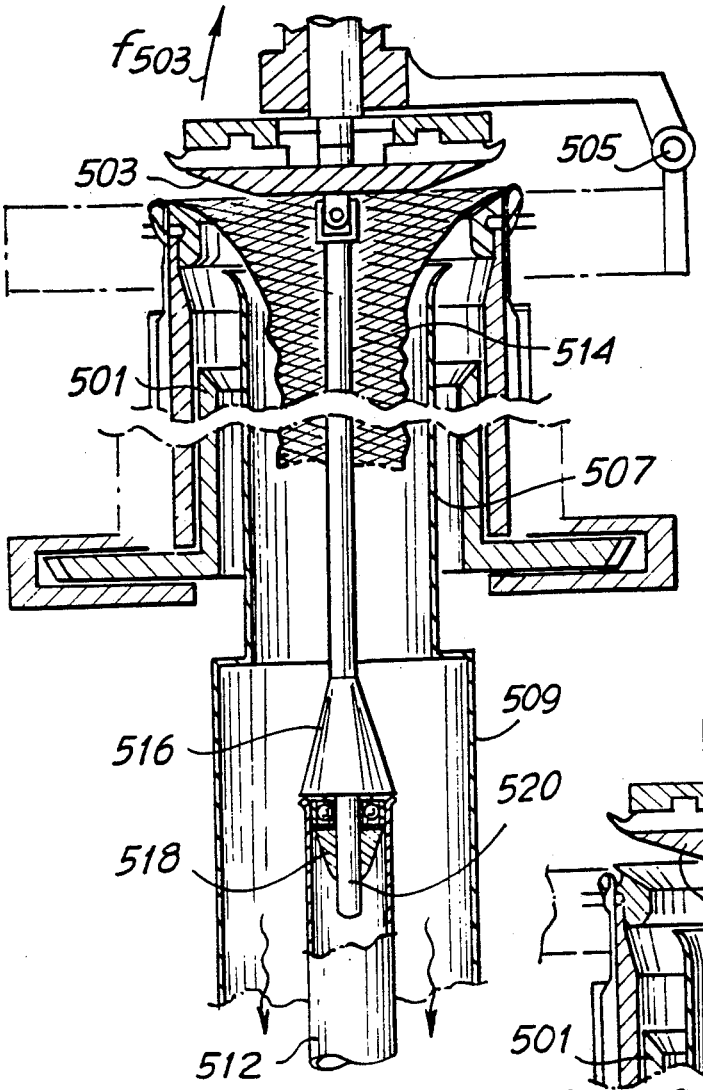
FIG. 7 shows schematically a sixth embodiment of the invention in the tensioning phase during the formation of the manufactured article.
Figure 8:
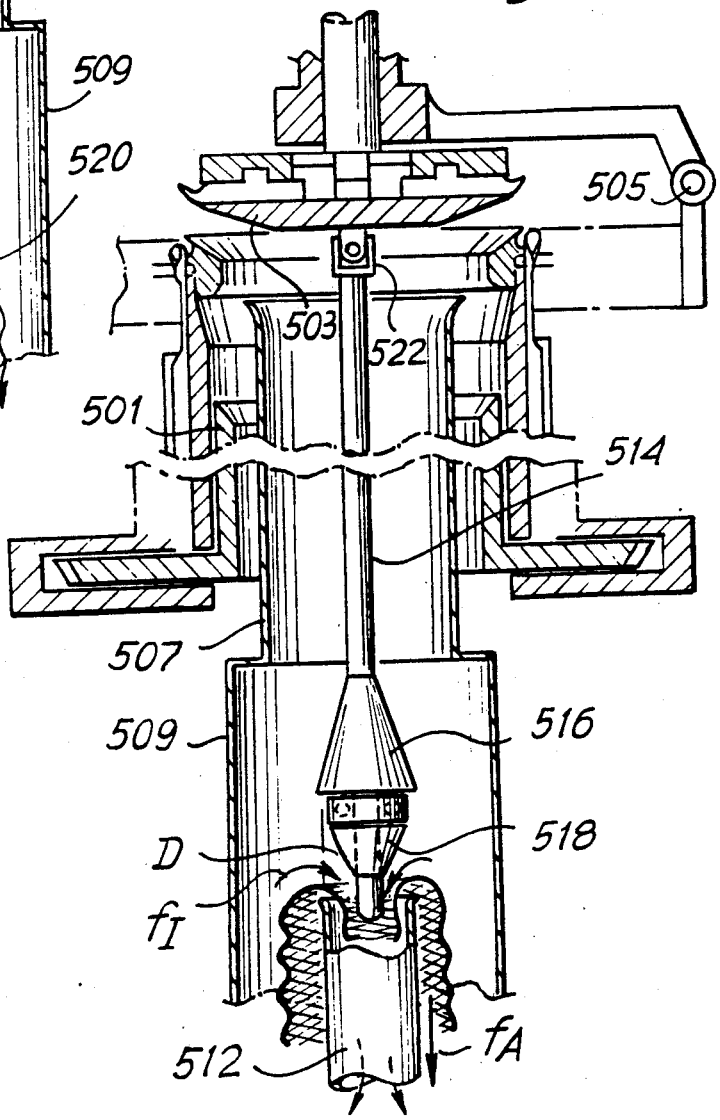
FIG. 8 shows the arrangement of the members of the sixth embodiment in the reversing phase.

The internal element which is made up of the tubular section 512 and of the assembly 514, 516, 518 and 520 is (as in the previous cases) such as to make up a continuous element in the condition shown in FIG. 7 for the formation of the tubular manufactured article as well as for the tensioning of the latter within the casing 507 and the interspace having annular cross-section defined by the portions 509, 512, as the cone 518 is engaged in the upper end opening of the section 512. When the reversing has to be performed, instead of sucking through the annular interspace between the components 509 and 512, an annular discontinuity D between the upper end of component 512 and cone 518 is formed and a suction is perfomed through the section 512 allowing the manufactured article to reverse and turn in on itself according to arrow fI (FIG. 8). This separation and thus this annular discontinuity D may be obtained by a lowering of the tubular section 512 according to arrow fA or by a lifting of the upper portion 514, 516, 518, 520.

Figure 9:
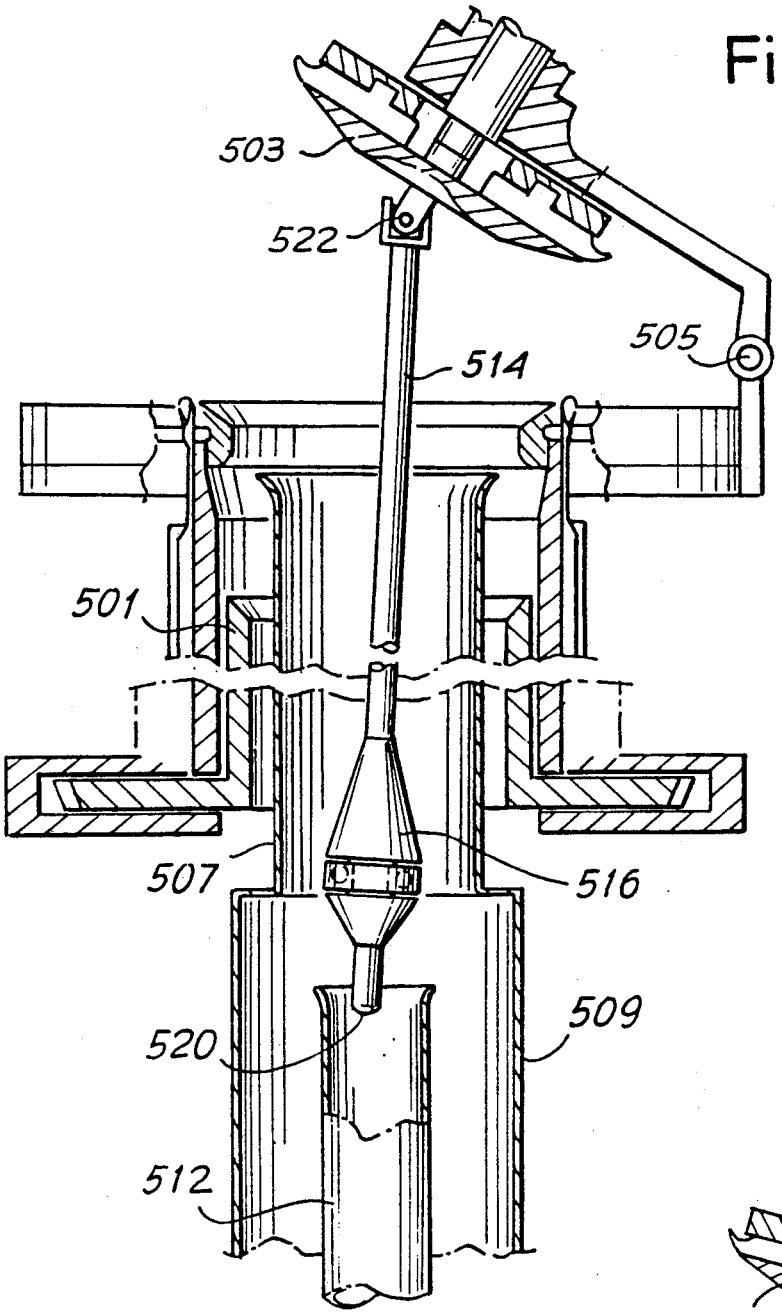
FIG. 9 shows the sixth embodiment with arrangement of the various members when the plate is lifted.

FIG. 9 shows the arrangement according to which the plate 503 is raised about the axis 505 to allow the access to the needle cylinder. The lifting of the plate causes the lifting of all the assembly 514, 516, 518 and 520, and the articulation 522 allows the plate to be inclined and the said assembly 514 to 520 to be lifted almost axially. The appengix 520 remains always within the upper end of the tubular section 512 during the lifting, so that, during the re-lowering of the plate assembly 503, the centering of the enlargement 516, 518 with respect to the tubular section 512, is ensured; should the appendix 520 come out from the opening of the tubular section 512 during the lifting, the reduced cross-section of this appendix 520 would anyway ensure its entering the tubular section 512 during the re-lowering of the paste. In practice, the appendix 520 ensures the regularity of the positioning of the lower end enlargement of rod 514 with respect to the tubular section 512.

Figure 10:
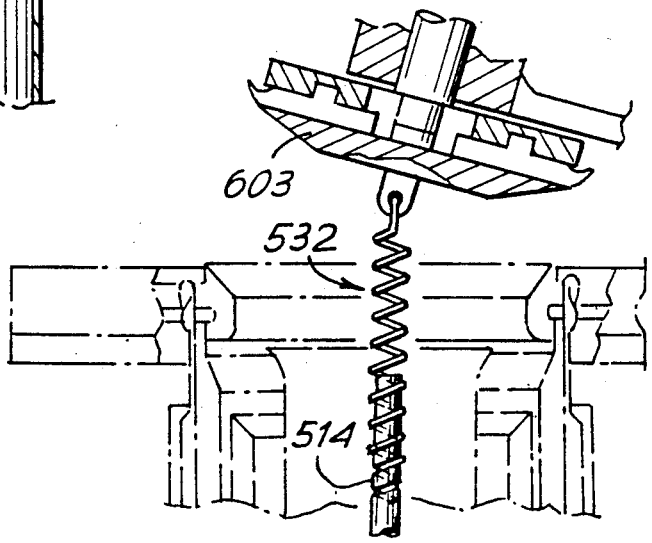
FIG. 10 shows a local, schematic view of a seventh embodiment.

In the modified embodiment of FIG. 10, the rod 514 is engaged to the structure of plate 503 through a flexible portion 532 (instead of an articulation 522) which is the operational equivalent for the above mentioned purposes.

In FIG. 11, 501 again denotes the rotating needle cylinder, and 503 very roughly denotes the hook plate which overhangs the needle cylinder and is carried by a structure articulated at 505 according to a horizontal and lateral axis to allow the lifting of the plate from the upper end of the needle cylinder according to arrow f503 in the drawing, in order to provide access for maintenance and allow working conditions to be resumed.

507′ denotes the upper section with a smaller diameter of the tubular casing which defines the passage for the pneumatic tensioning of the manufactured article during its formation; 509′ denotes the lower section with a larger diameter of said casing, which extends beneath the needle cylinder. 512 denotes the lower turbular section of the internal element which, together with section 509′, defines the interspace of annular section where the manufactured article being formed is collected prior to be reversed.

Inside the casing 507′, 509′ there is provided a rod 514 cooperating with the lower tubular section 512, which has an enlargement 516′ at the bottom, supported by ball bearings or other means, so as to rotate idly with respect to rod 514. The enlargement 516′ has a very thin end or a very thin appendix 520′, which extend axially downwards for the purposes indicated below. The rod 514 is articulated below the plate 503 at 522 and can rotate with the latter.

Figure 11:
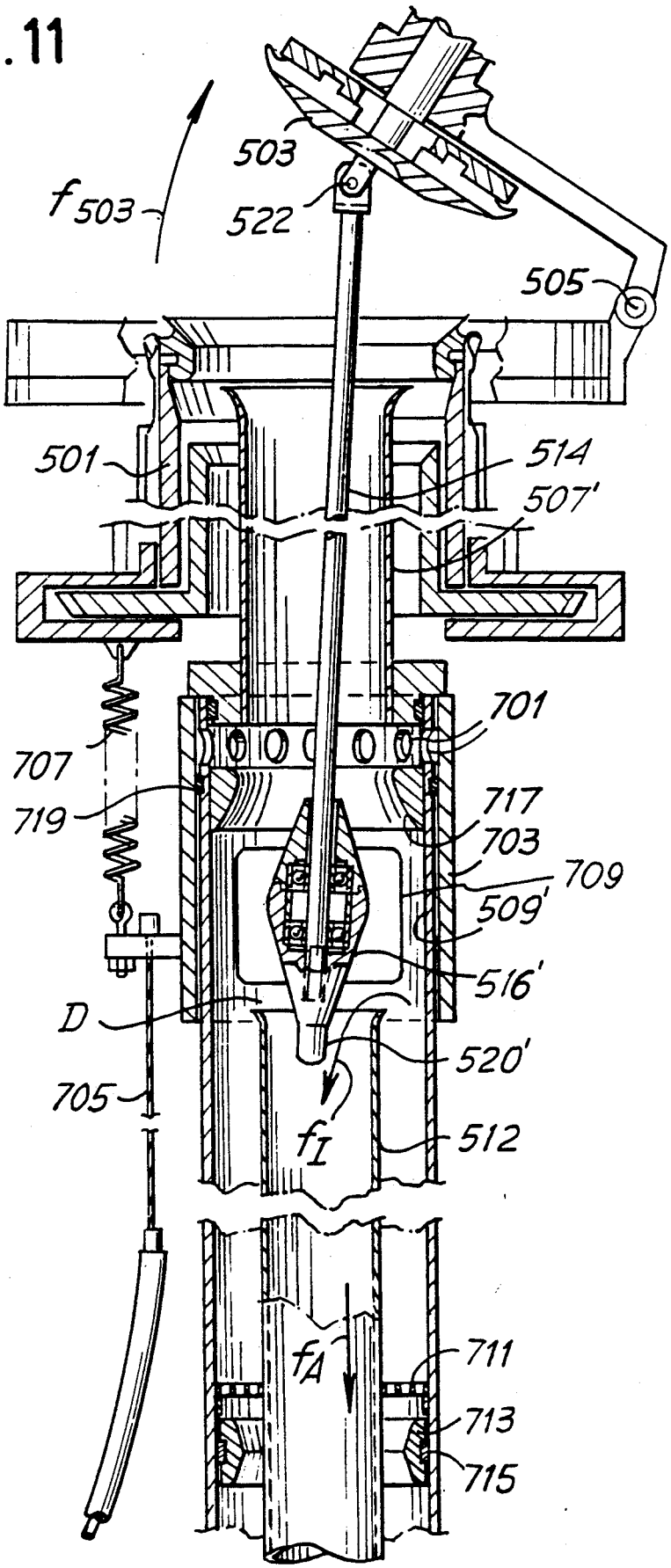
FIG. 11 shows a schematic view of an eighth embodiment.

According to FIG. 11, toward the upper end of the section 509′ with a larger diameter of casing 507′, 509′, there are provided holes 701 which open outwardly. An axially movable sleeve 703 may be moved either upwards to partially or completely shut said holes 701, or downwards to uncover them, by a programmed drive 705 and through counteracting springs. Beneath the set of holes 701, an access slotting 709 may be provided inside the casing 507′, 509′ to allow various interventions; said slotting is closed by the sleeve 703 and may be uncovered by imposing to said sleeve a stroke which is longer than the one for the uncovering of holes 701.

Within the interspace between the sections 509′ and 512, there may be inserted a grid 711 which is carried by an annular support 713 and the position of which is adjustable for example by means of the friction action exerted by a ring 715, made of rubber or similar material and carried by the support 713 against the internal surface section 512.

The internal element which is made up of the tubular section 512 and by the assembly 514, 516, 518 and 520, is such as to form a continuous element during the formation of the tubular manufactured article and during the tensioning of the latter within the casing 507′ and the interspace with annular cross-section defined by the parts 509′, 512, as the enlargement 516 is engaged within the upper end opening of the tubular section 512 and a suction is performed through the grid 711. The latter is adjusted in position according to the type of the manufactured article being formed and which has to be retained above said grid 711.

When the reversing has to be performed, instead of sucking through the annular interspace between the section 509' and 512 and through the grid 711, a discontinuity D is formed between the upper end of the section 512 and the enlargement 516', thereby determining a suction in the section 512 allowing the manufactured article to reverse and turn in on itself according to arrow fI. This separation and thus this annular discontinuity D can be obtained by a lowering of the tubular section 512 according to arrow fA or by a lifting of the upper portion 514, 516', 518, 520'. When the holes 701 are closed, a strong pneumatical draw is exerted on the manufactured article being formed, which is tensioned inside the section 507 with a smaller diameter of the casing 507, 509' when and as long as the holes 701 are closed. When the manufactured article is about to be abandoned by the needles, the holes 701 are opened, thereby allowing intake of air therethrough and consequently causing a reduction of air flow rate as well as a reduction of the pneumatic thrust exerted on the manufactured article in correspondence of cross-section 507; the manufactured article thereby arranges itself in the most suitable position for the subsequent reversing operation. The holes 701 are closed again only after the formation of the next article has begun, so that the initial phase of formation takes place in the absence of a significant pneumatic tensioning of the manufactured article.

The idly mounted enlargement 516' facilitates the above mentioned operations.

Means may be combined to the holes 701 in order to partially shut them and render the sucked air flow more regular. These means may be formed by an annular shaped structure 717 which is engaged to the internal surface of section 509' by means of a rubber ring 719 for the positioning adjustment of said structure 717; the shape of the latter is such as to render the air flow more regular.

The adjustability of grid 711 and the reduction of the air flow rate through the narrowest cross-section 507', 514 at the end of the formation of the manufactured article allow a suitable positioning of the manufactured article to be achieved in the section 509', 512 to facilitate the reversing thereof.

FIG. 11 shows the condition in which the plate 503 is lifted about axis 505 for the access to the needle cylinder. This lifting of the plate causes the lifting of the assembly 514, 516' and 520', and the articulation 522 allows the inclination of the plate and the almost axial lifting of said assembly 514 and 520'. During the lifting appendix 520' remains always within the upper end of the tubular section 512, so that, by lowering the plate 503 again, the centering of the enlargement 516 with respect to the tubular section 512 is ensured; even if the appendix 520' comes out from the opening of the tubular section 512 during the lifting, the reduced cross-section of this appendix 520' ensures always its entering the tubular section 512 when the plate is lowered again. In practice, the appendix 520' ensures a correct positioning of the lower end enlargement of rod 514 with respect to the tubular section 512.

I claim:

1. A device for pneumatically tensioning and reversing tubular manufactured articles such as socks, upon completion of the manufactured article by a circular knitting machine with a rotating needle cylinder, said device having an external tubular casing and an internal element for forming an interspace with an annular cross section for pneumatic tensioning, said internal element forming an axial passage inside which the manufactured article is turned inward and reversed during an operation where said article is reversed and pneumatically conveyed away, wherein both said tubular casing and said internal element each consists of two sections with different diameters, including upper sections with smaller diameters accommodated within the needle cylinder and lower sections with larger diameters located outside and adjacent to the needle cylinder; means being provided for forming an annular discontinuity between the two sections of said internal element so that, after a phase involving formation with pneumatic tensioning, a second pahse involving inward turning and reversal can be performed along an end edge of the internal element section of larger diameter, and within said tubular casing section of larger diameter, holes for the intake of external air and means for controlling the opening and closing of said holes in order to reduce the air flow rate within the tubular casing being arranged inside the needle cylinder and closer to a working zone of the needles.

2. The device as claimed in claim 1, wherein the section of said internal element with a smaller diameter is joined to an enlargement so as to have a diameter at least equal to that of the tubular section of said internal element with a larger diameter.

3. The device as claimed in claim 1, wherein the internal sections are movable axially relative to each other so as to create said annular discontinuity during the reversal phase.

4. The device as claimed in claim 1, wherein said holes are formed around said tubular casing section of larger diameter, said means for controlling including a sleeve shutter operable by a machine program, said sleeve shutter being slideable.

5. The device as claimed in claim 4, comprising, beneath the set of holes, a slotting for access into the tubular casing, which slotting is closed by said sleeve shutter and can be opened by an extra-run thereof.

6. The device as claimed in claim 5, wherein inside the section with a larger diameter of the tubular casing there is provided an annular shaped structure which is adjustable in position.

7. The device as claimed in claim 5, wherein inside the section with a larger diameter of the tubular casing a grid is provided which is adjustable in position, for intercepting the article in the interspace between the two sections with a larger diameter.

8. The device as claimed in claim, 2 wherein the enlargement is mounted for idly rotating relative to the end of the rod on which it is mounted.

9. A device for pneumatically tensioning and reversing tubular manufactured articles such as socks, upon completion of the manufactured articles by a circular knitting machine with a rotating needle cylinder, said device having an external tubular casing and an internal element for forming an interspace with an annular cross section for pneumatic tensioning, said internal element forming an axial passage inside which the manufactured article is turned inward and reversed during an operation where said article is reversed and pneumatically conveyed away, wherein each of said tubular casing and said internal element consists of two sections with small diameters being accommodated within the needle cylinder and lower sections with large diameters located outside and adjacent to the needle cylinder; means being provided for forming an annular discontinuity between the two sections of said internal element so that, after a phase involving formation with pneumatic tensioning, a second phase involving inward turning and reversal can be performed along an end edge of the internal element section of large diameter, and within said tubular casing section of large diameter, wherein the internal sections are movable axially relative to each other so as to create said annular discontinuity during the reversal phase, said means provided for forming an annular discontinuity includes an axially movable rod, wherein said internal element section of small diameter is mounted on said axially movable rod said rod moving said internal element section of small diameter axially so as to move towards and away from said internal element section of large diameter, which is fixed.

10. A device for pneumatically tensioning and reversing tubular manufactured articles such as socks, upon completion of the manufactured articles by circular knitting machine with a rotating needle cylinder, said device having an external tubular casing and an internal element for forming an interspace with an annular cross section for pneumatic tensioning, said internal element forming an axial passage inside which the manufactured article is turned inward and reversed during an operation where said article is reversed and pneumatically conveyed away, wherein each of said tubular casing and said internal element consists of two sections with different diameters, including upper sections with smaller diameters being accommodated within the needle cylinder and lower sections with larger diameters located outside and adjacent to the needle cylinder; means being provided for forming an annular discontinuity between the two sections of said internal element so that, after a phase involving formation with pneumatic tensioning, a second phase involving inward turning and reversal can be performed along an end edge of the internal element section of largér diameter, and within said tubular casing section of larger diameter, the upper section of said internal element is formed as a rod suspended from a plate and is able to be lifted with said plate; means being provided to ensure the centering of a lower enlargement of the rod with respect to the internal element section of larger diameter, the rod is articulated to the plate to allow an angular lifting of said plate.

11. A device for pneumatically tensioning and reversing tubular manufactured articles such as socks, upon completion of the manufactured article by a circular knitting machine with a rotating needle cylinder, said device having an external tubular casing and an internal element for forming an interspace with an annular cross section for pneumatic tensioning, said internal element forming an axial passage inside which the manufactured article is turned inward and reversed during an operation where said article is reversed and pneumatically conveyed away, wherein each of said tubular casing and said internal element consists of two sections with different diameters, including upper sections with smaller diameters being accommodated within the needle cylinder and lower sections with larger diameters located outside and adjacent to the needle cylinder; means being provided for forming an annular discontinuity between the two sections of said internal element so that after a phase involving formation with pneumatic tensioning, a second phase involving inward turning and reversal can be performed along an end edge of the internal element section of larger diameter, and within said tubular casing section of the larger diameter, said internal element section of smaller diameter is formed as a rod suspended from a plate and is able to be lifted with said plate; centering means provided to ensure the centering of said rod with respect to the internal element section of larger diameter said centering means including a conical portion at a lower end of said rod and an appendix connected to a lower end of said conical portion.

* * * * *